US007980204B2

(12) United States Patent
Okumura et al.

(10) Patent No.: US 7,980,204 B2
(45) Date of Patent: Jul. 19, 2011

(54) RESERVE TANK

(75) Inventors: Hiroyuki Okumura, Obu (JP); Toshirou Matsubara, Toyota (JP); Hiroaki Nakano, Toyota (JP); Tadashi Akiyama, Okazaki (JP); Yasuji Nishi, Toyota (JP); Shinji Miyawaki, Anjo (JP)

(73) Assignees: Denso Corporation, Kariya (JP); Toyota Jidosha Kabushiki Kaisha, Toyota (JP)

( * ) Notice: Subject to any disclaimer, the term of this patent is extended or adjusted under 35 U.S.C. 154(b) by 646 days.

(21) Appl. No.: 12/082,417

(22) Filed: Apr. 10, 2008

(65) Prior Publication Data

US 2008/0289590 A1 Nov. 27, 2008

(30) Foreign Application Priority Data

Apr. 13, 2007 (JP) ..... 2007-106186

(51) Int. Cl.
*F01P 3/22* (2006.01)

(52) U.S. Cl. ..... 123/41.54; 165/104.32

(58) Field of Classification Search ..... 123/41.54; 165/104.32

See application file for complete search history.

(56) References Cited

U.S. PATENT DOCUMENTS 4,064,848 A * 12/1977 Pabst et al. ..... 123/41.54

FOREIGN PATENT DOCUMENTS

| | | |
|---|---|---|
| JP | 60-88028 | 6/1985 |
| JP | 2005-120906 | 5/2005 |
| JP | 2006-329052 | 12/2006 |

OTHER PUBLICATIONS

Office action dated Feb. 12, 2010 in corresponding Chinese Application No. 2008 10191169.4.

Office action dated Jul. 28, 2009 in corresponding Japanese Application No. 2007-106186.

* cited by examiner

*Primary Examiner* — Noah Kamen

(74) *Attorney, Agent, or Firm* — Harness, Dickey & Pierce, PLC

(57) ABSTRACT

A reserve tank includes a tank body for storing coolant, an inflow portion for allowing the coolant to flow into the tank body, a guide portion, and an outflow portion for allowing the coolant to flow out of the tank body. The guide portion is disposed above the inflow portion and below a liquid level of the coolant in the tank body. Furthermore, the guide portion is adapted to guide a flow of the coolant flowing thereinto from the inflow portion and directed upward, substantially in a horizontal direction or downward with respect to the horizontal direction. Therefore, the reserve tank can restrict air from being trapped in coolant.

6 Claims, 6 Drawing Sheets

RESERVE TANK

CROSS REFERENCE TO RELATED APPLICATION

This application is based on Japanese Patent Application No. 2007-106186 filed on Apr. 13, 2007, the contents of which are incorporated herein by reference in its entirety.

FIELD OF THE INVENTION

The present invention relates to a circulation-type reserve tank.

BACKGROUND OF THE INVENTION

Conventionally, a coolant circuit for cooling a heating unit mounted on a vehicle is provided with a reserve tank for absorbing a change in volume of coolant caused by a change in temperature thereof (see, for example, JP-A-2005-120906). In recent years, a predetermined clearance is required to be provided between an engine component and a bonnet so as to absorb impact on the bonnet for the protection of pedestrians. This imposes a stricter restriction on installing of components in an engine room, and thus requires reduction in size of the reserve tank.

Increase in size of the engine, in number of control components, or the like tends to reduce a space for installing of the components in the engine room. Thus, a contour of the reserve tank is complicated so as to enable ensuring a necessary capacity effectively using an empty space. Further, a pipe connected to the reserve tank is run in a narrow space, which imposes the stricter restriction on positions of an inflow portion and an outflow portion of the reserve tank.

However, some small-sized reserve tanks or vertically thin reserve tanks cannot sufficiently ensure the depth of coolant retained. Moreover, some reserve tanks are formed to have a complicated contour that interrupts the flow of the coolant flowing into the tank. In such a reserve tank, a liquid level may be disturbed due to a flow of the coolant, thereby causing air to be trapped in the coolant. The circulation of the coolant with the air trapped therein through the coolant circuit may reduce cooling performance of a heat exchanger provided in the coolant circuit, or a lifetime of a water pump to generate abnormal noise in a water pump.

SUMMARY OF THE INVENTION

In view of the foregoing problems, it is an object of the invention to provide a reserve tank that can restrict air from being trapped in coolant.

According to an example of the present invention, a reserve tank includes a tank body for storing coolant, an inflow portion for allowing the coolant to flow into the tank body, a guide portion, and an outflow portion for allowing the coolant to flow out of the tank body. Furthermore, the guide portion is disposed above the inflow portion and below a liquid level of the coolant in the tank body. In addition, the guide portion is adapted to guide a flow of the coolant flowing thereinto from the inflow portion and directed upward, substantially in a horizontal direction or downward with respect to the horizontal direction.

Thus, the flow of the coolant directed toward the liquid level is guided by the guiding portion in the horizontal direction or downward with respect to the horizontal direction, which can prevent disturbance of the liquid level. This can prevent the air from being trapped (contained) in the coolant.

For example, the guide portion has a flat plate member arranged substantially horizontally. This simplifies the structure of the guiding portion.

Alternatively, the reserve tank may further include an inlet portion, provided at an upper surface of the tank body, for injecting the coolant into the tank body. In this case, the guide portion is formed in an area other than an area vertically below the inlet portion. This can prevent a reduction in injection characteristics when injecting the coolant via the inlet portion.

Furthermore, the inflow portion may be disposed near an outer wall of the tank body, or a partition wall for partitioning the tank body into a plurality of sections. In this case, the inflow portion is adapted to allow the coolant to flow into the tank body toward the outer wall or the partition wall. Thus, the guiding portion can be provided in a range between the inflow portion and the outer wall or partition wall, thereby reducing the size of the guiding portion.

Alternatively, the inflow portion may include: a curved pipe portion for changing a direction of a flow of the coolant flowing from an outside, in a substantially vertically upward direction; and a straight pipe portion connected to the curved pipe portion and extending vertically upward in the tank body. In this case, the straight pipe portion may have an opening formed at a part of a side thereof. The straight pipe portion has the direction of the opening changed relatively easily by being rotated around a tube shaft. This can easily change the inflow direction of the coolant into the tank body. Furthermore, the straight pipe portion may be made of a stainless steel.

According to another example of the present invention, a reserve tank includes: a tank body for storing coolant; an inflow portion for allowing the coolant to flow into the tank body; a flat plate-shaped guide portion having a lower end surface that is located substantially at the same height as that of an upper end surface of an opening of the inflow portion; and an outflow portion for allowing the coolant to flow out of the tank body.

Thus, the flow of the coolant directed toward the liquid level is guided by the guiding portion horizontally or downward with respect to the horizontal direction, thereby preventing disturbance of the liquid level. This can prevent the air from being trapped in the coolant.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

First Embodiment

Figure 1:
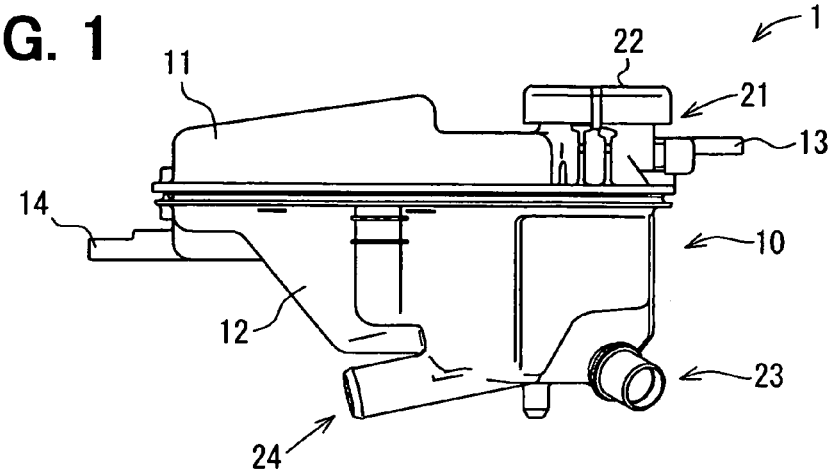
FIG. 1 is a front view showing an entire structure of a reserve tank according to a first embodiment.
Figure 2:
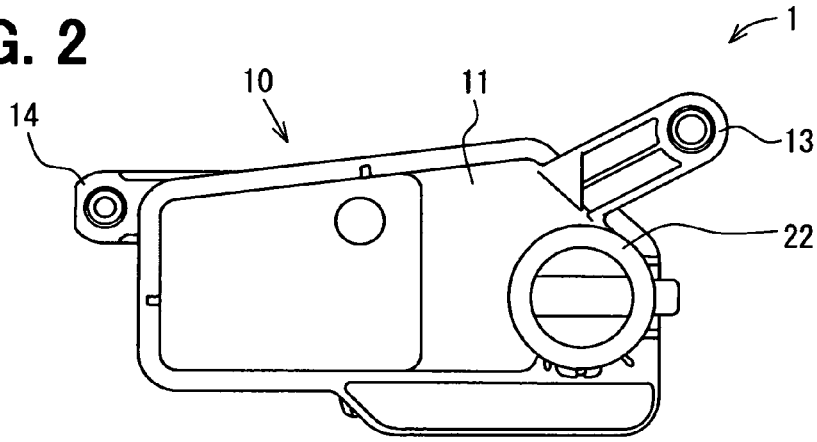
FIG. 2 is a top view showing the entire structure of the reserve tank in the first embodiment.

A first embodiment of the invention will be described below using FIGS. 1 to 9B. FIG. 1 is a front view showing the entire structure of a reserve tank according to this embodiment, and FIG. 2 is a top view showing the entire structure of the reserve tank. As shown in FIGS. 1 and 2, the reserve tank 1 has a hollow tank body 10. The tank body 10 retains coolant such that a liquid level L is not less than a lower limit level L1 nor more than an upper limit level (full water level) Lf (see FIG. 7). The tank body 10 is formed using, for example, thermoplastic resin, and includes an upper tank 11 and a lower tank 12 which are connected to each other by welding. The reserve tank 1 has brackets 13 and 14 for fixing the tank inside an engine room of a vehicle. The bracket 13 is integrally formed with the upper tank 11, and the bracket 14 is integrally formed with the lower tank 12. The reserve tank 1 is provided in the midway point of the coolant circuit so as to absorb a change in volume of the coolant for cooling a heating unit, such as an engine, due to a change in temperature of the coolant.

An inlet 21 for injecting the coolant into the reserve tank 1 is provided in the front surface of the upper tank 11. A pressure cap 22 is attached to the inlet 21. The lower tank 12 has at its bottom surface, an inflow portion 23 for allowing the coolant to flow into the tank body 10, and an outflow portion 24 for allowing the coolant to flow from the tank body 10.

Figure 3:
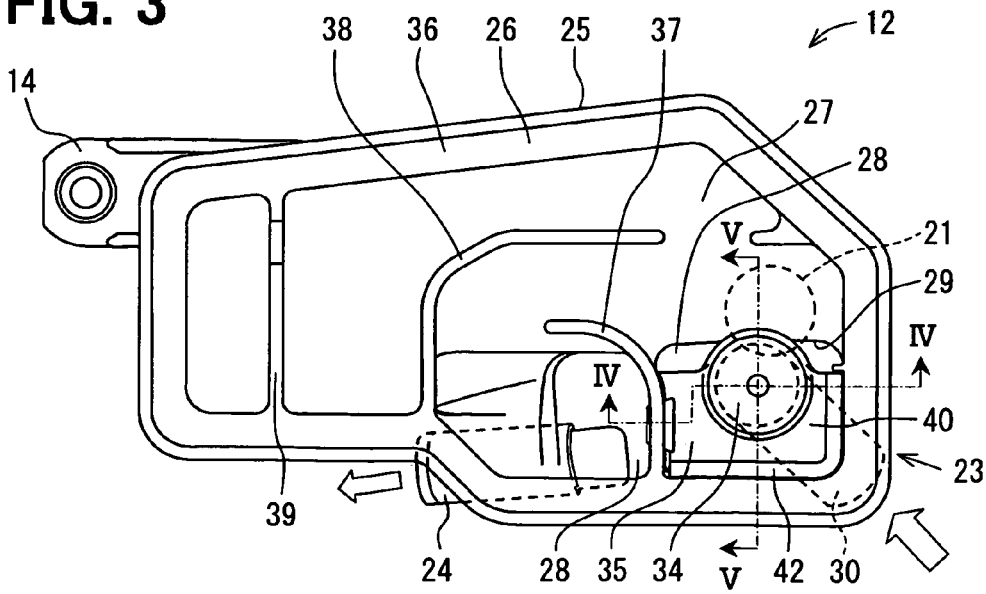
FIG. 3 is a top view showing the structure of a lower tank.
Figure 4:
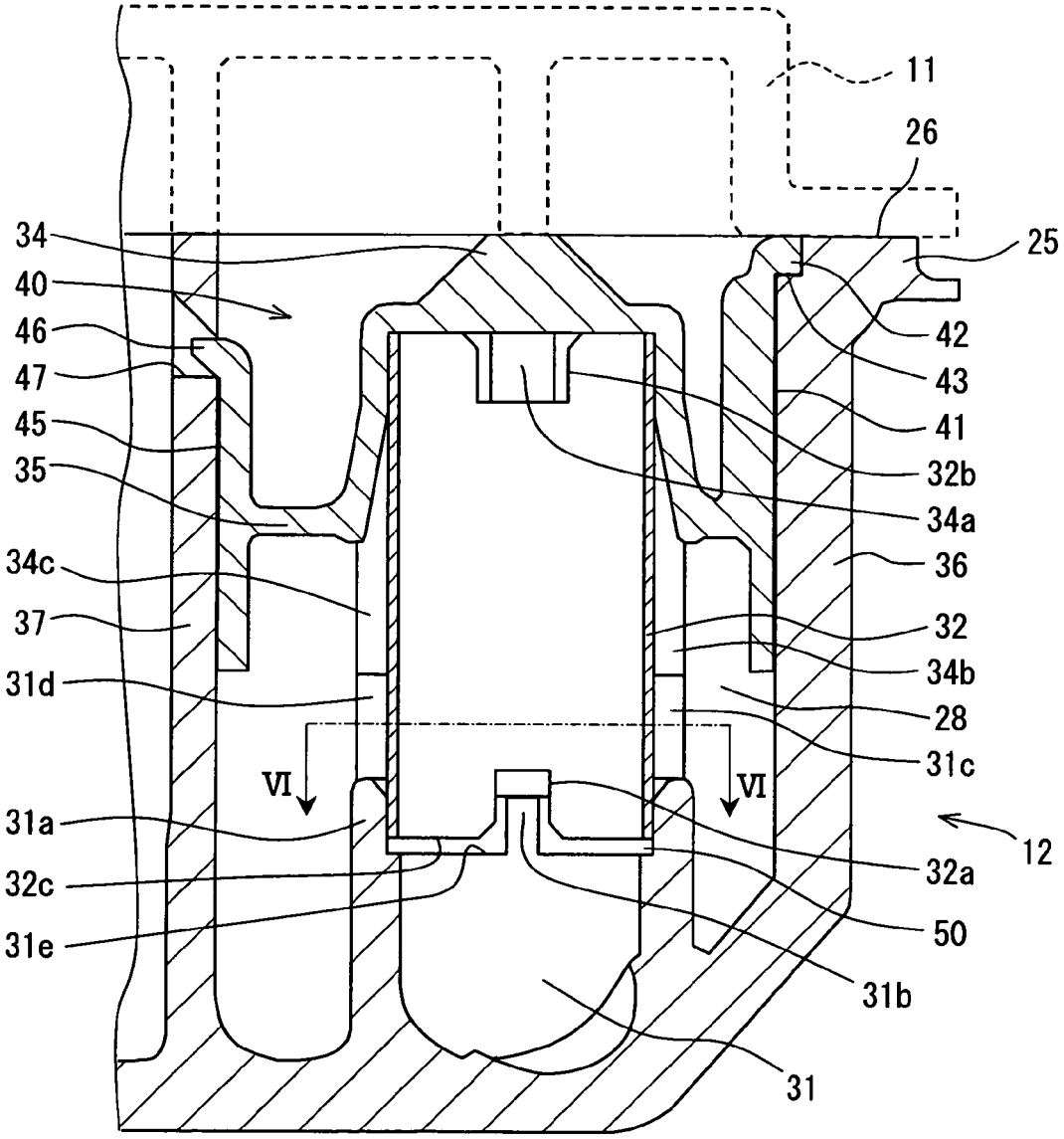
FIG. 4 is a sectional view showing the lower tank structure taken along the line IV-IV of FIG. 3.
Figure 5:
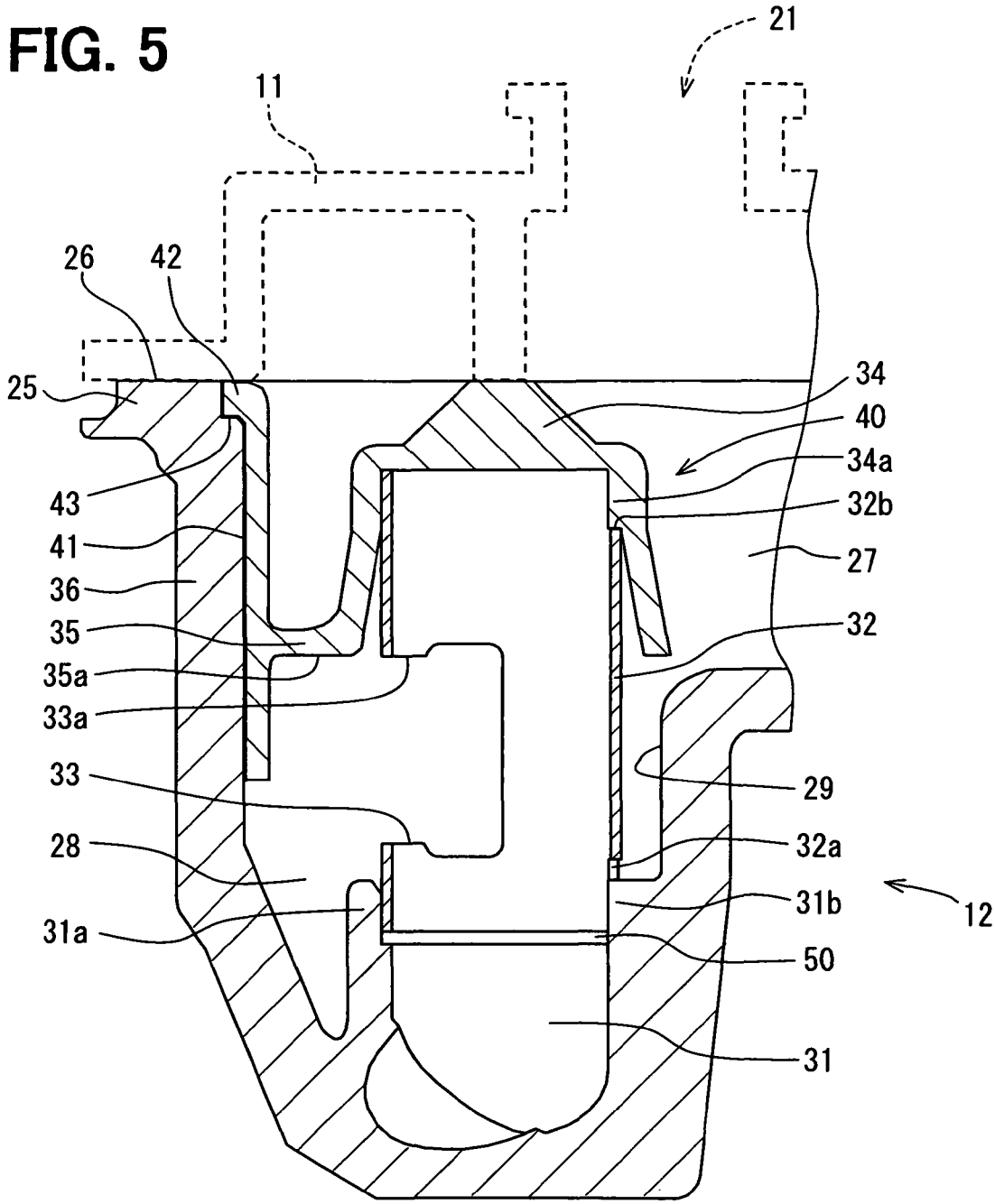
FIG. 5 is a sectional view showing the lower tank structure taken along the line V-V of FIG. 3.
Figure 6:
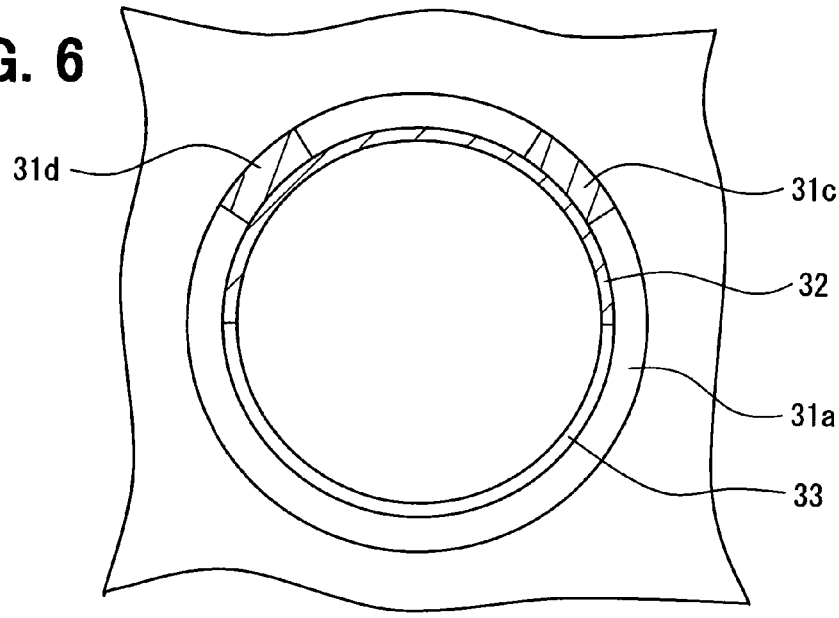
FIG. 6 is a sectional view showing the lower tank structure taken along the line VI-VI of FIG. 4.

FIG. 3 is a top view showing the structure of the lower tank 12. FIG. 4 is a sectional view showing the structure of the lower tank 12 taken along the line IV-IV of FIG. 3. FIG. 5 is a sectional view showing the structure of the lower tank 12 taken along the line V-V of FIG. 3. FIG. 6 is a sectional view showing the structure of the lower tank 12 taken along the line VI-VI of FIG. 4. In FIG. 3, the position of the inlet 21 formed on the upper tank 11 side is indicated by the broken line. The thick arrow in FIG. 3 indicates the flow direction of the coolant.

As shown in FIGS. 3 to 6, the lower tank 12 is provided with a shallow bottom 27 having a relatively shallow depth, the inflow portion 23, the outflow portion 24, and a deep bottom 28 which is deeper than the shallow bottom 27. The lower tank 12 has a plate-like shape having the entire periphery enclosed by an outer wall 36. A longitudinal wall 29 is formed in a step portion between the shallow bottom 27 and the deep bottom 29 which differ from each other in depth. The longitudinal wall 29 has an upper side connected to the bottom surface of the shallow bottom 27 and a lower side connected to the bottom surface of the deep bottom 28.

A flange 25 for connection with the upper tank 11 by welding is formed in the upper portion of the outer wall 36. The flange 25 has a welding surface 26 formed around the entire periphery thereof in a relatively wide width so as to ensure a standard dimension of a welding margin. The welding surface 26 of the lower tank 12 has the entire periphery welded to a welding surface formed in the outer periphery of the upper tank 11 in the same way as that of the surface 26, so that a connection portion between the lower tank 12 and the upper tank 11 is sealed.

The lower tank 12 includes partition walls 37, 38, and 39 for partitioning the inside of the tank into a plurality of sections, and for promoting separation of the coolant into liquid and gas phases by taking a long flow path from the inflow portion 23 to the outflow portion 24. The upper surfaces of the partition walls 37, 38, and 39 are welding surfaces welded and connected to partition walls formed on the upper tank 11 side in the same way as that of the partition walls 37, 38, and 39.

The inflow portion 23 is positioned at an area enclosed from three directions by two surfaces adjacent to each other via an edge of the outer wall 36 and the partition wall 37. The inflow portion 23 includes a straight inflow pipe 30 connected to a coolant pipe of the coolant circuit, a curved pipe portion 31 for changing the flow direction of the coolant flowing thereinto in a predetermined direction via an inflow pipe 30 to a vertically upward direction, and a straight rectifying pipe 32 connected to the curved pipe portion 31 and extending vertically upward.

The inflow pipe 30 protrudes from the bottom face of the deep bottom 28 of the lower tank 12 toward a predetermined direction outside the tank. One end of the curved pipe portion 31 is connected to the inflow pipe 30, and the other end protrudes vertically upward from the bottom face of the deep bottom 28. A cylindrical seat 31*a* is formed on the other end of the curved pipe portion 31. The seat 31*a* has an inner diameter that is larger than that of the main body of the curved pipe portion 31. A protrusion 31*b* protruding toward the inner side (center side) is formed in a part of the seat 31*a*. Two assembly guides 31*c* and 31*d* for facilitating assembly of the rectifying pipe 32 to be described later extend vertically upward from the seat 31*a*.

The straight rectifying pipe 32 is press-fitted into the seat 31*a*. The rectifying pipe 32 extends vertically along the assembly guides 31*c* and 31*d*. The rectifying pipe 32 can be relatively thin, and is formed using stainless steel having high corrosion resistance to a LLC (antifreeze solution) used as the coolant. The rectifying pipe 32 has the inner diameter larger than that of the main body of the curved pipe portion 31. This can suppress the increase in flow rate of the coolant in the rectifying pipe 32, thereby preventing the disturbance of the coolant flow. A lower end surface 32*c* of the rectifying pipe 32 is not in contact with a lower end surface 31*e* of the seat 31*a* to form a predetermined clearance 50.

A cutout portion 32*a* cut so as to surround the protrusion 31*b* of the seat 31*a* is formed on the lower end of the rectifying pipe 32. A cutout portion 32*b* that is cut more widely than the cutout portion 32*a* and a protrusion 34*a* to be described later is formed at the upper end of the rectifying pipe 32.

An opening 33 is opened in a part of the side of the rectifying pipe 32. The opening 33 is formed in a range of a half cycle of the rectifying pipe 32 in the circumferential direction so as to be opposed to the outer wall 36 and the partition wall 37. The upper end surface 33*a* of the opening 33 is located below the lower limit level Ll of the liquid level of the tank body 10. That is, the opening 33 is located below the liquid level L in normal use of the reserve tank 1. The opening 33 is adapted to allow the coolant to flow toward the outer wall 36 and the partition wall 37 in the tank body 10.

A rectifying cap 40 integrally molded is provided above the rectifying pipe 32. The rectifying cap 40 includes a cap portion 34 press-fitted into the upper end of the rectifying pipe 32, and a peaked flat plate member 35 fitted into an area enclosed by the outer wall 36 and the partition wall 37 and covering the vicinity of the opening 33. The upper surface of the cap portion 34 is positioned at the same height as that of each of the upper surfaces of the outer wall 36 and the partition wall 37, and serves as a welding surface which is to be welded to the upper tank 11. The protrusion 34*a* protruding inward in a position corresponding to the cutout portion 32*b* of the rectifying pipe 32 is formed in the cap portion 34. The protrusion 34*a* is formed more widely than the cutout portion 32*a* of the rectifying pipe 32.

The rectifying cap 40 includes two leg portions 34*b* and 34*c* extending vertically downward from the cap portion 34 along the side of the rectifying pipe 32. The tips of the leg portions 34*b* and 34*c* are abutted against the tips of the assembly guides 31*c* and 31*d*, respectively.

The flat plate member 35 is disposed substantially horizontally and located below the lower limit level L1 of the liquid level of the tank body 10. That is, the flat plate member 35 is located below the liquid level of the coolant in the tank body 10. A lower surface 35*a* of the flat plate member 35 is disposed substantially at the same height as that of the upper end surface 33*a* of the opening 33. The flat plate member 35 serves as a guide portion for changing and guiding the flow direction of the coolant flowing from the opening 33 into the tank body 11 and directed upward (toward the liquid level side), substantially in the horizontal direction or downward with respect to the horizontal direction. The flat plate member 35 is disposed in an area other than an area vertically below the inlet 21 on the upper tank 11 side.

The rectifying cap 40 includes a contact surface 41 provided on the outer wall 36 side of the outer periphery of the flat plate member 35 and adapted to be in surface-contact with the outer wall 36. The cap 40 also includes an engagement portion 42 provided on the upper end of the contact surface 41 and engaged with a cutout portion 43 formed on the inner side of the upper end of the outer wall 36. The upper surface of the engagement portion 42 is located substantially at the same height as that of the upper surface of the outer wall 36, and serves as the welding surface which is to be welded to the upper tank 11. The rectifying cap 40 is provided on the partition wall 37 side of the outer periphery of the flat plate member 35. The cap 40 includes a contact surface 45 provided on the outer wall 37 side of the outer periphery of the flat plate member 35 and adapted to be in surface-contact with the partition wall 37. The cap 40 also includes an engagement claw portion 46 provided on the upper end of the contact surface 45 and engaged with an engagement hole 47 formed in the partition wall 37.

Figure 7A:
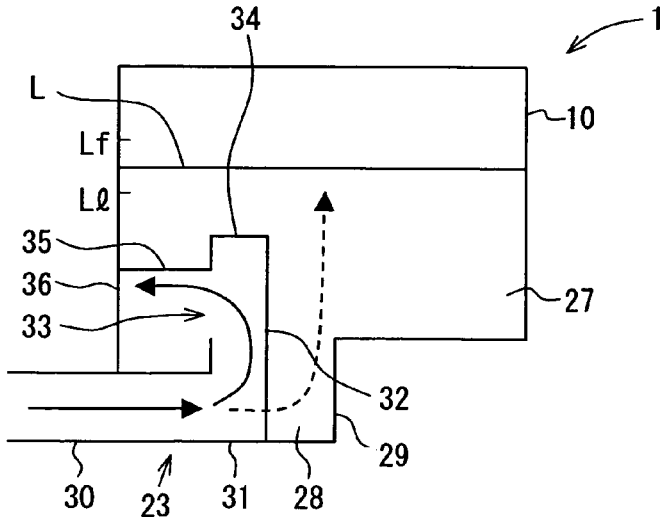
FIG. 7A is a schematic diagram showing a flow of coolant in the reserve tank in the first embodiment.
Figure 7B:
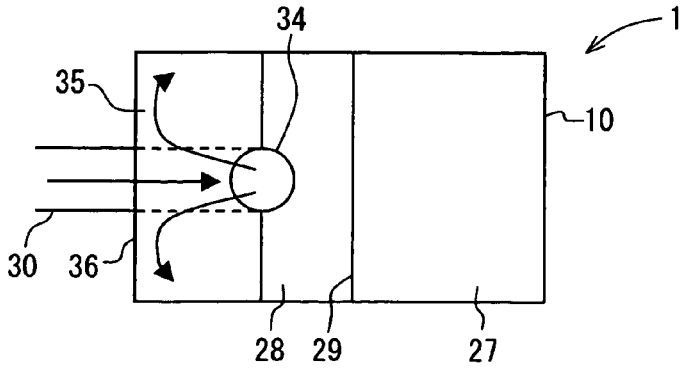
FIG. 7B is a schematic diagram showing a flow of coolant in the reserve tank in the first embodiment.

Now, the flow of coolant in the reserve tank 1 will be described below. FIG. 7A shows a state of the reserve tank 1 as viewed in the horizontal direction, and FIG. 7B shows a state of the reserve tank 1 as viewed from a vertically upward direction. As indicated by the arrows with the broken lines in FIGS. 7A and 7B, in a conventional reserve tank having the same contour as that of the reserve tank 1 of this embodiment, the coolant flowing thereinto attacks the longitudinal wall 29 to proceed toward the liquid level side. This may disturb the liquid level to cause the air to be trapped into the coolant.

In contrast, in the reserve tank 1 of this embodiment, the coolant flowing thereinto via the inflow pipe 30 in the predetermined direction has its flow path curved by the curved pipe portion 31 to proceed vertically upward, and then flows into the rectifying pipe 32. The coolant flowing into the rectifying pipe 32 flows into the tank body 10 via the opening 33. The direction of the flow of coolant flowing into the tank body 10 is the horizontal direction or upward with respect to the horizontal direction as shown in FIG. 7A. As shown in FIG. 7B, the coolant flows semi-radially as viewed from the plane.

The flow of coolant flowing into the tank body 10 is interrupted by the lower surface 35*a* of the flat plate member 35 horizontally disposed below the liquid level, and guided substantially in the horizontal direction or downward with respect to the horizontal direction. The flat plate member 35 is formed up to the outer wall 36, thereby preventing the coolant flow from proceeding to the liquid level side even when it is interrupted by the outer wall 36.

Next, a manufacturing method of the reserve tank 1 according to this embodiment will be described below. First, the upper tank 11, the lower tank 12, and the rectifying cap 40, each of which has a corresponding predetermined shape, are formed using thermoplastic resin. Further, the rectifying pipe 32 is also formed using stainless steel. The rectifying pipe 32 is formed such that the height of the upper surface of the cap 34 is not higher than that of the upper surface of the outer wall 36. Further, the rectifying pipe 32 is formed in such a length that the clearance 50 is formed between the pipe 32 and the lower end surface 31*e* of the seat 31*a* when the assembly is completed.

Then, one end of the rectifying pipe 32 (upper end shown in FIGS. 4 and 5) is press-fitted into the cap 34 of the rectifying pipe 40. Positioning of the rectifying cap 32 with respect to the cap 34 in the rotational direction with the tube shaft of the cap 32 centered is performed by aligning the cutout portion 32*b* of the rectifying cap 32 with the protrusion 34*a* of the cap 34. The cutout portion 32*a* formed on the other end of the rectifying pipe 32 is formed more narrowly than the protrusion 34*a*, thereby preventing the rectifying pipe 32 from being wrongly assembled upside down.

Figure 8:
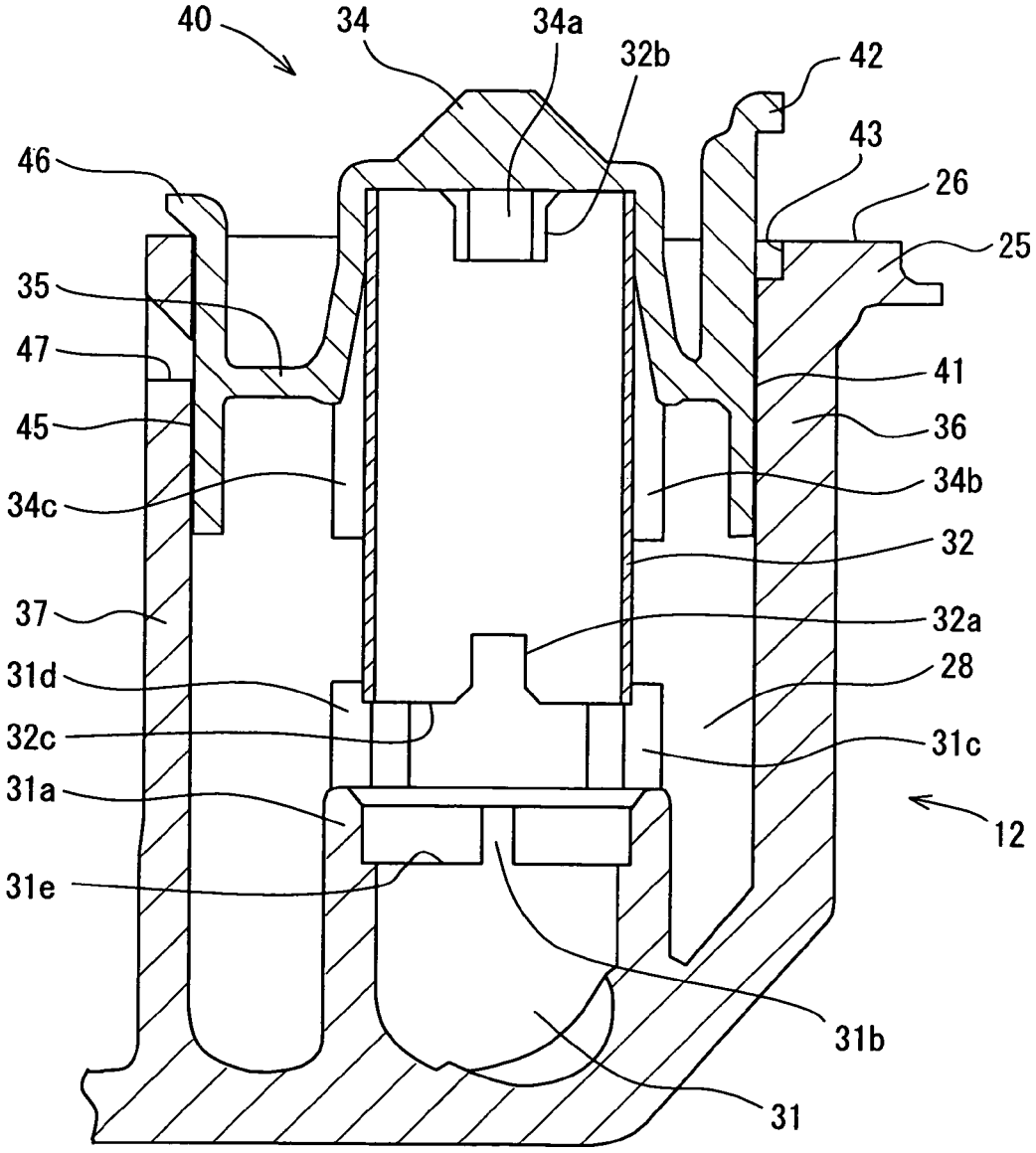
FIG. 8 is a sectional view of the lower tank corresponding to FIG. 4.

Then, the rectifying cap 40 is fitted into an area enclosed from three directions by the outer wall 36 and the partition wall 37 in the lower tank 12. FIG. 8 is a sectional view of the lower tank 12 corresponding to FIG. 4, showing a state in which the rectifying cap 40 is being fitted into the lower tank 12. As shown in FIG. 8, the contact surfaces 41 and 45 of the rectifying cap 40 are brought into surface contact with the outer wall 36 and the partition wall 37, respectively, to slide downward, while the side walls on the other end of the rectifying pipe 32 are aligned along the assembly guides 31*c* and 31*d*. The rectifying pipe 32 can be aligned along the assembly guides 31*c* and 31*d* before the engagement claw portion 46 of the rectifying cap 40 runs on the upper end of the partition wall 37.

Thereafter, a downward load is further applied to the rectifying cap 40, causing the engagement claw portion 46 to be engaged with the engagement hole 47 of the partition wall 37, while causing the other end of the rectifying pipe 32 to be press-fitted into the seat 31*a*. This fixes the rectifying cap 40 to the lower tank 12, thereby preventing the cap 40 from becoming misaligned. The tips of the leg portions 34*b* and 34*c* of the rectifying cap 40 are abutted against the tips of the assembly guides 31*c* and 31*d* to cause the engagement portion 42 to be engaged with the cutout portion 43. Through the steps described above, the rectifying cap 40 is fitted into the area enclosed from the three directions by the outer wall 36 and the partition wall 37, which completes the assembling of the lower tank 12.

Next, the lower tank 12 and the upper tank 11 are welded to each other using hot plate welding. In this case, the respective upper surfaces of the outer wall 36, the partition wall 37, the cap 34, and the engagement portion 42 of the lower tank 12 serve as the welding surface. At this time, the engagement claw portion 46 is engaged with the engagement hole 47 to fix the rectifying cap 40 to the lower tank 12. Also, when a hot plate after pressing of the welding surface is peeled away from the lower tank 12, the rectifying cap 40 is prevented from being misaligned with respect to the lower tank 12. The upper surface of the outer wall 36 has the entire periphery welded to the outer wall of the upper tank 11, so that the connecting portions of the upper tank 11 and the lower tank 12 are sealed. The respective upper surfaces of the partition wall 37, the cap 34, and the engagement portion 42 are welded to the upper tank 11, which can prevent the disturbance of the coolant flow in these connection portions.

In this embodiment, the flow of coolant flowing into the tank body 10 and directed toward the liquid level side is guided by the flat plate member 35 serving as a guide portion in the horizontal direction or the downward direction with respect to the horizontal direction, thereby preventing the disturbance of the liquid level of the coolant. This can prevent air from being trapped into the coolant even when the reserve tank 1 is formed in a complicated shape that interferes with the flow of coolant. Also, in this embodiment, the flat plate member 35 having a flat plate shape serves as the guide portion, thereby providing the above-mentioned effect with a simple structure.

Further, in this embodiment, the flat plate member 35 is formed in an area other than the portion vertically below the inlet 21. This can prevent decrease in injection characteristics of the coolant.

In this embodiment, the inflow portion 23 is provided in an area disposed relatively near and enclosed by the outer wall 36 and the partition wall 37, and the opening 33 is formed to be opposed to the outer wall 36 and the partition wall 37. Thus, the flat plate member 35 may be provided between the opening 33, and the outer wall 36 and the partition wall 37, which can reduce the size of the flat plate member 35.

The inflow portion 23 has the rectifying pipe 32 extending vertically and having the opening 33 formed on a part of the side thereof. The rectifying pipe 32 relatively easily changes the direction of the opening 33 by being rotated with the tube shaft centered. The inflow direction of the coolant into the tank body 10 can be easily changed based on the arrangement of the outer wall 36 and the partition wall 37 and the position of the inlet 21 and the like.

Figure 9A:
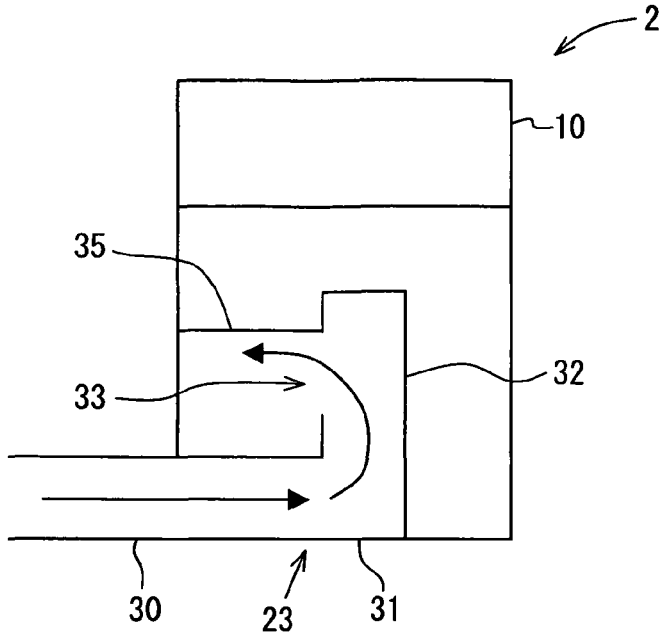
FIG. 9A is a schematic diagram showing a modified example of the reserve tank in the first embodiment.
Figure 9B:
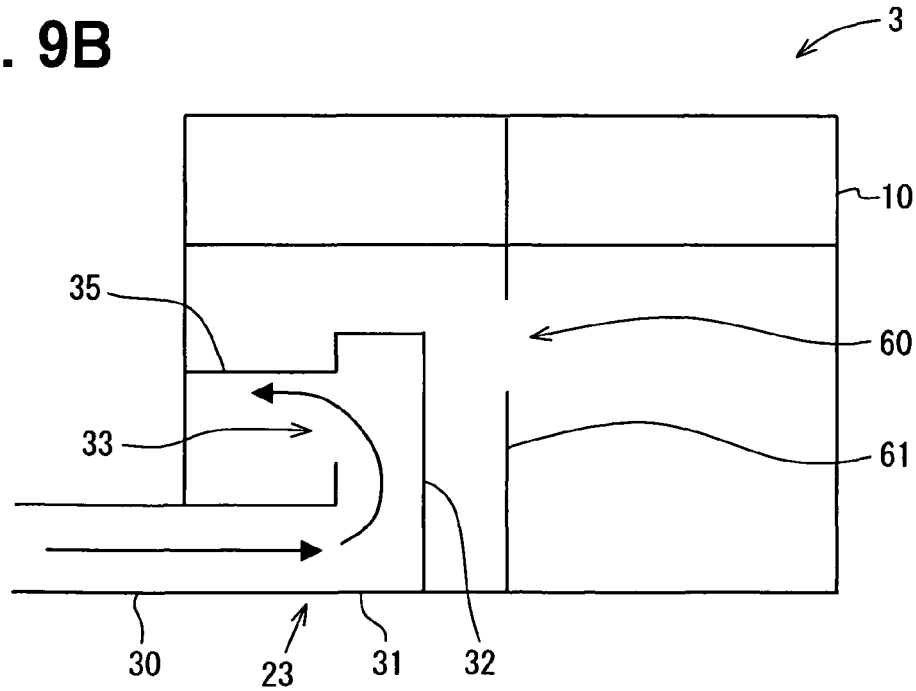
FIG. 9B is a schematic diagram showing a modified example of the reserve tank in the first embodiment.

The small-sized (narrow) reserve tank 2 shown in FIG. 9A and the reserve tank 3 having a restriction that a communication hole 60 is formed in the partition wall 61 as shown in FIG. 9B also obtain the same effects as those described above.

According to an aspect of the above-described embodiment, a reserve tank includes a tank body 10 for storing coolant, an inflow portion 23 for allowing the coolant to flow into the tank body 10, a guide portion (35), and an outflow portion (24) for allowing the coolant to flow out of the tank body 10. Furthermore, the guide portion (35) is disposed above the inflow portion 23 and below a liquid level of the coolant in the tank body 10. In addition, the guide portion (35) is adapted to guide a flow of the coolant flowing thereinto from the inflow portion 23 and directed upward, substantially in a horizontal direction or downward with respect to the horizontal direction.

Thus, the flow of the coolant directed toward the liquid level is guided by the guiding portion (35) in the horizontal direction or downward with respect to the horizontal direction, which can prevent disturbance of the liquid level. Accordingly, it can prevent the air from being trapped (contained) in the coolant.

For example, the guide portion (35) has a flat plate member arranged substantially horizontally. This simplifies the structure of the guiding portion (35).

Furthermore, the reserve tank may further include an inlet portion 21, provided at an upper surface of the tank body 10, for injecting the coolant into the tank body 10. In this case, the guide portion (35) is formed in an area other than an area vertically below the inlet portion 21. This can prevent a reduction in injection characteristics when injecting the coolant via the inlet portion 21.

Furthermore, the inflow portion 23 may be disposed near an outer wall 36 of the tank body 10, or a partition wall 37 for partitioning the tank body 10 into a plurality of sections. In this case, the inflow portion 23 is adapted to allow the coolant to flow into the tank body 10 toward the outer wall 36 or the partition wall 37. Thus, the guiding portion (35) can be provided in a range between the inflow portion 23 and the outer wall 36 or partition wall 10, thereby reducing the size of the guiding portion (35).

Furthermore, the inflow portion 23 includes: a curved pipe portion 31 for changing a direction of a flow of the coolant flowing from an outside, in a substantially vertically upward direction; and a straight pipe portion (32) connected to the curved pipe portion 31 and extending vertically upward in the tank body. In this case, the straight pipe portion may have an opening 33 formed at a part of a side thereof. The straight pipe portion (32) has the direction of the opening 33 changed relatively easily by being rotated around a tube shaft. This can easily change the inflow direction of the coolant into the tank body 10. For example, the straight pipe portion (32) may be made of a stainless steel.

According to another aspect of the above-described embodiment, a reserve tank includes: a tank body 10 for storing coolant; an inflow portion 23 for allowing the coolant to flow into the tank body 10; a flat plate-shaped guide portion (flat plate member 35) having a lower end surface 35*a* that is located substantially at the same height as that of an upper end surface 33*a* of an opening 33 of the inflow portion 23; and an outflow portion 24 for allowing the coolant to flow out of the tank body 10.

Thus, the flow of the coolant directed toward the liquid level is guided by the guiding portion horizontally or downward with respect to the horizontal direction, thereby preventing disturbance of the liquid level. This can prevent the air from being trapped in the coolant.

Other Embodiments

Although the present invention has been fully described in connection with the preferred embodiments thereof with reference to the accompanying drawings, it is to be noted that various changes and modifications will become apparent to those skilled in the art.

For example, although in the above-mentioned embodiments the rectifying pipe 32 used is made of, for example, stainless steel, the rectifying pipe 32 may be integrally formed with the lower tank 12 using thermoplastic resin.

Although in the above-mentioned embodiments the flat plate member 35 having a flat plate shape is provided as the guide portion, the invention is not limited thereto. The guide portion may have any other shape that guides the flow of coolant flowing into the tank body 10 and directed toward the liquid level, substantially in the horizontal direction or the downward direction with respect to the horizontal direction.

Although in the above-mentioned embodiments the flat plate member 35 serving as the guide portion is disposed below the lower limit level L1 of the liquid level, the guide portion can prevent the air from being trapped into the coolant due to the disturbance of the liquid level as long as the guide portion is located below the liquid level of the coolant in the tank body 10.

Such changes and modifications are to be understood as being within the scope of the present invention as defined by the appended claims.

What is claimed is:

1. A reserve tank comprising:

a tank body for storing coolant;

an inflow portion for allowing the coolant to flow into the tank body;

a guide portion disposed above the inflow portion and below a liquid level of the coolant in the tank body, wherein the guide portion is adapted to guide a flow of the coolant flowing from the inflow portion and direct the flow of the coolant upward or substantially in a horizontal direction or downward with respect to the horizontal direction; and an outflow portion for allowing the coolant to flow out of the tank body wherein the inflow portion includes: a curved pipe portion for changing a direction of the flow of the coolant to a substantially vertically upward direction; and a straight pipe portion connected to the curved pipe portion and extending vertically upward in the tank body, the straight pipe portion having an opening formed at a part of a side thereof.

2. The reserve tank according to claim 1, wherein the guide portion has a flat plate member arranged substantially horizontally.

3. The reserve tank according to claim 1, further comprising an inlet portion, provided at an upper surface of the tank body for allowing the coolant to enter into the tank body, wherein the guide portion is formed in an area other than an area vertically below the inlet portion.

4. The reserve tank according to claim 1, wherein the inflow portion is disposed near an outer wall of the tank body, the inflow portion being adapted to allow the coolant to flow into the tank body toward the outer wall.

5. The reserve tank according to claim 1, wherein the straight pipe portion is made of stainless steel.

6. The reserve tank according to claim 1, wherein the inflow portion is disposed near a partition wall for partitioning the tank body into a plurality of sections, the inflow portion being adapted to allow the coolant to flow into the tank body toward the partition wall.

* * * * *